United States Patent [19]

Vogel

[11] 4,099,319

[45] Jul. 11, 1978

[54] METHOD OF ASSEMBLY OF ELECTRIC HEATING ELEMENT WITH BULKHEAD FITTING

[75] Inventor: Alan D. Vogel, Laurel, Md.

[73] Assignee: Electro-Therm, Inc., Laurel, Md.

[21] Appl. No.: 800,886

[22] Filed: May 26, 1977

Related U.S. Application Data

[62] Division of Ser. No. 564,938, Apr. 3, 1975, Pat. No. 4,035,609.

[51] Int. Cl.[2] ..... H05B 3/00

[52] U.S. Cl. ..... 29/611; 29/517; 29/520

[58] Field of Search ..... 29/505, 517, 520, 515, 29/610, 611; 219/335, 336, 523, 316, 318

[56] References Cited

U.S. PATENT DOCUMENTS

| | | | |
|---|---|---|---|
| 2,785,270 | 3/1957 | Burger | 219/38 |
| 3,116,401 | 12/1963 | Drugmand | 219/38 |
| 3,354,294 | 11/1967 | Kollar et al. | 219/536 |

*Primary Examiner*—Victor A. DiPalma

*Attorney, Agent, or Firm*—Henry W. Collins; Paul C. Flattery; Eugene M. Cummings

[57] ABSTRACT

An electric heating element assembly includes a solderless fitting for sealably securing a sheathed heating element through an aperture in a container wall or bulkhead, such as in a dishwasher or the like. The fitting includes a cylindrical sleeve positioned over the sheath of the heating element and through the aperture. A radial flange on the fitting is drawn tight against a gasket and the wall by means of a fastener on the outside surface of the sleeve to secure a watertight seal between the fitting and the wall. The sleeve is attached to the sheath by means of an annular lip on the face of the flange, circumferential portions of this lip being axially compressed during assembly so as to radially-inwardly deform corresponding circumferential portions of the sleeve and the sheath to obtain a rotationally-locked liquid-sealing engagement therebetween.

2 Claims, 8 Drawing Figures

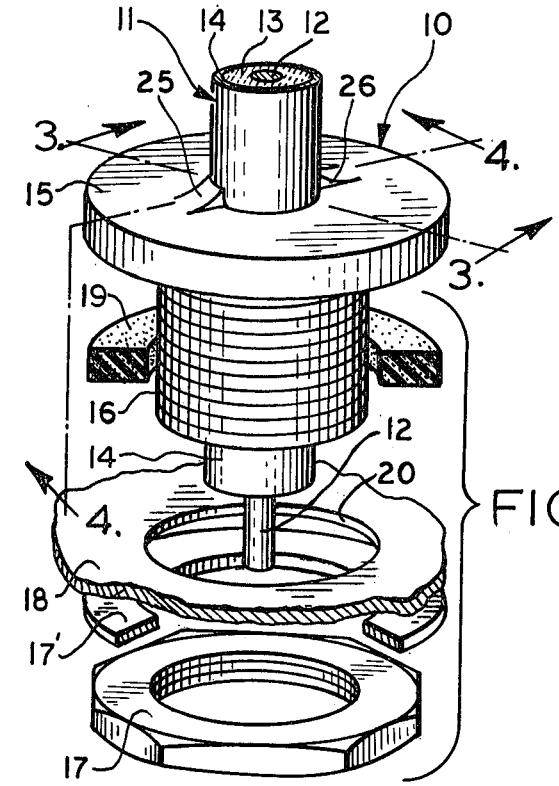
FIG. 1
FIG. 4
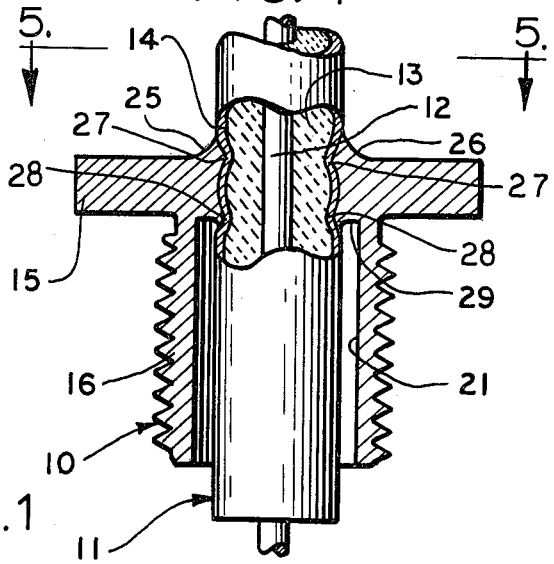
FIG. 3
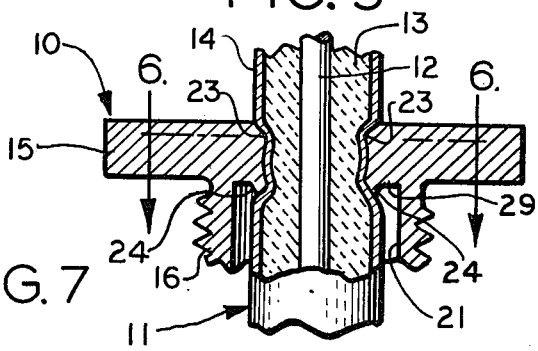
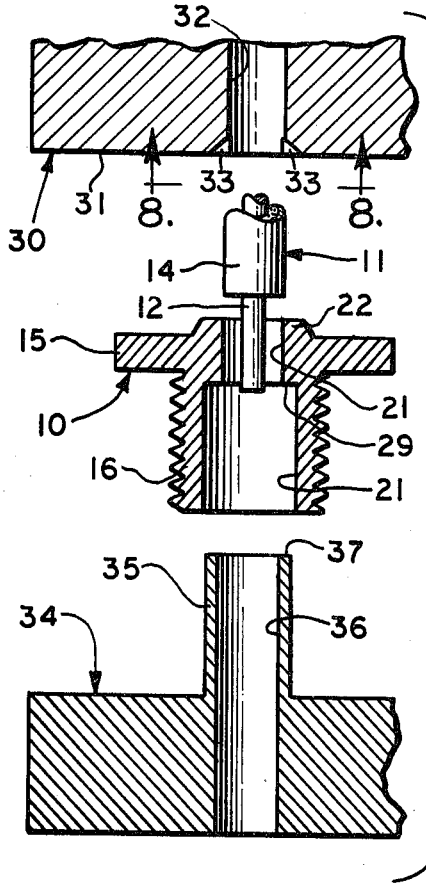
FIG. 7
FIG. 2
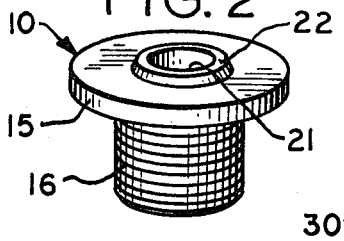
FIG. 8
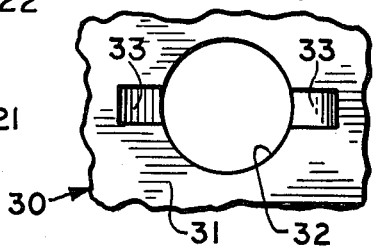
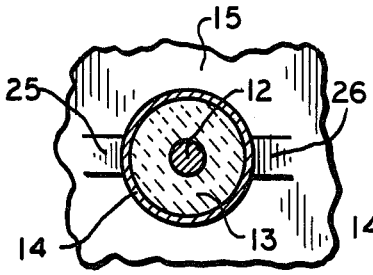
FIG. 5
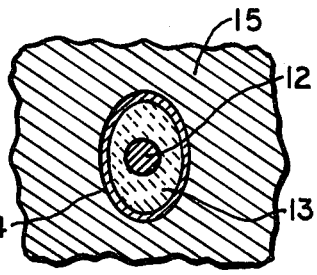
FIG. 6

METHOD OF ASSEMBLY OF ELECTRIC HEATING ELEMENT WITH BULKHEAD FITTING

This is a division of application Ser. No. 564,938, now U.S. Pat. No. 4,035,609, filed Apr. 3, 1975.

BACKGROUND OF THE INVENTION

This invention relates generally to electric heating element assemblies, and particularly to bushings or fittings for sheathed electrical conductors, and more particularly to a solderless fitting and method for establishing a mechanically-rigid liquid-tight seal between the sheath of an electrical rod-type heating element and the wall of a container.

Electrical rod-type heating elements of the type commonly used in water heaters, stoves, and other appliances generally consist of a resistance wire or conductor surrounded by a concentric heat-conductive electrically-insulating material, such as magnesium oxide, and an outer electrically-conductive metal sheath. The sheath, which serves to provide a desired shape to the heating element and to protect the insulating material and resistance wire from damage, may be formed of a malleable metal and grounded to protect against electrical shock. The use of such electrical heating elements in automatic dishwashers and other closed liquid systems necessitates that the heating element pass through the wall of a liquid container in order to be supplied with electrical power. This creates the need for a mechanically-rigid, liquid-tight and electrically conductive fitting between the sheath and the container wall which can preferably be installed on the sheath without the need for time-consuming soldering, brazing, or welding operations, and without damaging the sheath or the resistance wire, the insulation, or the electrical conductor container therein.

One difficulty encountered in prior-art solderless fittings for mounting sheathed heating elements was that the fittings tended to loosen from the sheaths as they were tightened, particularly after the fittings had been loosened and tightened several times. The resulting rotation between the sheaths and the fittings had the effect of destroying the liquid sealing capability of the fittings and making further tightening or loosening of the fittings difficult.

SUMMARY OF THE INVENTION

The invention is directed to an electric heating element assembly for mounting through an aperture in a bulkhead. The assembly comprises a sheathed electrical heating element, a fitting including a radial flange portion having a diameter greater than the bulkhead aperture, a sleeve portion integrally adjacent and concentric with the flange portion and having an outer diameter smaller than the bulkhead aperture and a length greater than the thickness of the bulkhead, fastener receiving means on the sleeve portion for engaging a fastener for drawing the flange portion into engagement with the bulkhead, the flange and sleeve portions including an axially-extending aperture through which the sheathed heating element is extended, and the wall of the axially-extending aperture being deformed to decrease the cross-sectional area of at least a portion of the aperture so as to establish a solderless mechanically-rigid liquid-seal with the sheath of the heating element.

The invention is further directed to a fitting for securing a sheathed electric heating element through an aperture in a bulkhead. The fitting comprises a radial flange portion having a diameter greater than the bulkhead aperture, a sleeve portion integrally adjacent and concentric with the flange portion and having an outer diameter smaller than the bulkhead aperture and a length greater than the thickness of the bulkhead, fastener receiving means on the sleeve portion for engaging a fastener for drawing the flange portion into engagement with the bulkhead, the flange and sleeve portions including an axially-extending aperture dimensioned to slidably receive the sheath of the heating element, and lip means on the surface of the flange portion for deforming the wall of the axially-extending aperture in response to an externally-applied compressive force to decrease the cross-sectional area of at least a portion of the aperture so as to establish a solderless mechanically-rigid liquid-seal with the sheath.

The invention is further directed to a method of securing a fitting to a sheathed electrical conductor, the fitting being of the type which sealably passes the conductor through an aperture in a bulkhead and includes a flange portion having a diameter greater than the bulkhead aperture, a sleeve portion integrally adjacent and concentric with the flange portion having an outer diameter smaller than the bulkhead aperture and a length greater than the thickness of the bulk-head, and a threaded portion for receiving a fastener for drawing the flange portion into engagement with the bulkhead, the flange and sleeve portions including an axially-extending aperture dimensioned to slidably receive in surface contact the sheath of the conductor, and a lip on the face of the flange portion adjacent to the axially-extending aperture. The method includes the steps of inserting the sheathed electrical conductor through the axially-extending aperture so as to bring the sheath into surface-contact with the wall of the axially-extending aperture, and axially compressing the lip into the face of the flange portion so as to force the wall of the axially-extending aperture and the sheath to be radially deformed whereby a mechanically-rigid liquid-sealing engagement is established between the fitting and the sheath.

BRIEF DESCRIPTION OF THE DRAWINGS

The features of the present invention, which are believed to be novel, are set forth with particularity in the appended claims. The invention, together with the further advantages thereof, can best be understood by reference to the following description taken in connection with the accompanying drawings, in the several figures of which like reference numerals identify like elements, and in which:

FIG. 1 is a perspective exploded view, with parts shown in section and broken away, illustrating the installation into a bulkhead of an electric heating element assembly and fitting constructed in accordance with the principles of the present invention;

FIG. 2 is a perspective view of the fitting prior to being secured to the sheathed heating element;

FIG. 3 is a partial cross-sectional view of the fitting and a partial cross-sectional view of the sheathed heating element taken along line 3—3 of FIG. 1;

FIG. 4 is a cross-sectional view of the fitting and a partial cross-sectional view of the heating element taken along line 4—4 of FIG. 1;

FIG. 5 is a cross-sectional view taken along line 5—5 of FIG. 4;

FIG. 6 is a cross-sectional view taken along line 6—6 of FIG. 3;

FIG. 7 is an exploded assembly view taken partially in cross section showing the use of opposing die members for assembling the fitting onto the heating element sheath; and FIG. 8 is a plan view taken along line 8—8 of FIG. 7.

DESCRIPTION OF THE PREFERRED EMBODIMENT

Referring to the figures, and particularly to FIG. 1, a heating element assembly constructed in accordance with the principles of the invention includes a bushing or fitting 10 fixedly secured near one end of a conventional rod-type or sheath-type heating element 11, which may include a central terminal lead 12 or cold pin for establishing in electrical contact with its resistance wire, a heat-conductive electrically-insulating material 13 and a metallic outer sheath 14. Fitting 10, which is preferably formed from a semi-malleable metal such as brass, steel, or aluminum, includes an annular flange portion 15 and an adjoining sleeve portion 16, at least a portion of which is threaded to receive a conventional electrically conductive flat washer 17' and a conventional hex nut 17 or other suitable fastening means. When installed in a bulkhead or wall 18 the sleeve portion 16 of fitting 10 is passed through an appropriately sized aperture 20 in the bulkhead and hex nut 17 is turned onto the threaded portion of the sleeve. This draws the flange portion 15 into tight sealing engagement with a gasket 19 sandwiched between the bulkhead and the flange to achieve a liquid-sealed connection and support for the heating element.

Referring to FIG. 2, fitting 10 includes a central axially-extending aperture 21 dimensioned to receive sheath 14, preferably in a predetermined size relationship. As shown in FIG. 3, this aperture extends through both the radial portion 15 and the sleeve portion 16 of the fitting, being of slightly increased diameter in the sleeve portion. (In one particular embodiment a five to six thousandths of an inch with conventional tolerances was found adequate to allow easy assembly and yet still allow a watertight fit after assembly in accordance with the method of the invention to be presently described.) An annular shoulder 29 is formed where aperture 21 increases in diameter between the flange and sleeve portions of the fitting.

In accordance with the invention, a solderless liquid-tight rotationally-locked attachment is obtained between fitting 10 and the outer sheath 14 of heating element 11 by means of lip portion 22 on the face of flange portion 15, adjacently surrounding aperture 21. When fitting 10 is installed on heating element 11 portions of lip 22 are compressed axially with respect to aperture 21. As shown in FIG. 3, this causes a radially-inward deformation 23 of the wall of aperture 21 in sleeve portion 16, a corresponding radially-inward deformation of sheath 14 and an axially-downward and radially-inward deformation 24 of fitting 10 adjacent shoulder 29. These deformations, which result from cold flow of the malleable metals of the sheath and fitting, serve to form a mechanically-tight liquid sealing engagement between the fitting and the sheath.

In further accord with the invention, rotation of fitting 10 with respect to heating element 11 is prevented by providing two diametrically opposed circumferential portions 25 and 26 (FIGS. 1, 4 and 5) on the annular lip 22 of fitting 10 which are not axially compressed to the same extent as the rest of the lip. As shown in FIG. 4, this has the effect of causing a lesser radially-inward deformation 27 of the walls of aperture 21 and sheath 14, and a lesser axially-downward and radially-inward deformation 28 of fitting 10 adjacent shoulder 29. As a result, the wall of aperture 21 and sleeve 14, when viewed in cross section, as in FIG. 6, are out-of-round or oval. Consequently, the fitting and sleeve are effectively rotationally locked as well as being liquid sealed.

A method for installing fitting 10 onto the sheathed heating element 11 is illustrated in FIG. 7. The method utilizes a first die member 30 having a working surface 31 and a central aperture 32 of approximately the same diameter as aperture 21 in the flange portion 15 of fitting 10. As shown in FIG. 8, a pair of radially-outwardly extending channels 33 are provided at diametrically-opposed locations on working surface 31 about the circumference of aperture 32 for the purpose of forming the rotation-locking portions 25 and 26 of lip 22.

The method also utilizes a second die member 34 having an upwardly projecting hollow cylindrical working portion 35. The outer diameter of working portion 35 is approximately the same as the diameter of aperture 21 in sleeve portion 16 so that portion 35 is slidably received therein. Working portion 34 includes an aperture 36 having approximately the same diameter as aperture 21 in flange portion 15 for slidably receiving sheath 14, and a flat ring-shaped anvil surface 37 on its projecting end.

In installing fitting 10 on heating element 11, sheath 14 is inserted through aperture 32 in die member 30, through aperture 21 in fitting 10, and through aperture 36 in die member 34. Fitting 10 is next positioned on die member 34 with the hollow cylindrical working portion 35 of the die member extending into aperture 21 so that its anvil portion 37 abuts shoulder 29. At the same time the working surface 31 of die member 30 is brought into abutment with the top surface of lip portion 22. The two die members 30 and 34 are now axially compressed, causing lip portion 22, except where it abuts channels 33, to be compressed in an axial direction so as to form the radially-inward deformation 23 of the wall of aperture 21 and sheath 14 shown in FIG. 3. Since the opposed channels 33 in the working surface 31 of die member 30 prevent the underlying circumferential portions of lip 22 from being compressed to the same extent as adjacent portions which do not underlie the channels, the inward deformation 27 of the wall of aperture 21 is appreciably less at these locations, as shown in FIG. 4. As a result, the radial distortion of aperture 21 and sheath 14 brought about by die members 30 and 34 is oblong as shown in FIG. 6, and fitting 10 and heating element 11 are rotatably locked in liquid-sealed engagement.

The axial deformations 24 (FIG. 3) and 28 (FIG. 4) of the wall of aperture 21 occur as a result of anvil surface 37 pressing against shoulder 29 as lip 22 is compressed by die member 30. These deformations may be viewed as secondary deformations of fitting 10 and sheath 14 which assist the aforedescribed deformations 23 (FIG. 3) and 27 (FIG. 4) in achieving a mechanically-tight liquid seal.

The extent of the radial deformation of fitting 10 and sheath 14 is dependent to a large extent on the height of the raised lip portion 22 above the face of flange portion 15. In practice the height of lip 22 is such that a deformation results which is sufficient to obtain a mechanically-tight liquid seal, but not so large as to damage the insulating sleeve 13 of sheath 14 of heating element 11. The extent to which the deformation deviates from true round is controlled by the depth of channels 33. For maximum deviation from true round, which corresponds to a minimum deformation 27 in FIG. 4, the channels are formed to have a depth equal to or greater than the height of lip 22. For less deviation the channels are formed shallower to obtain a greater deformation 27. In practice the bottom surfaces of channels 33 may be inclined or chamfered to provide a radially outwardly-increasing partial axial compression of lip 22, the partially compressed lip forming rotation-locking portions 25 and 26 with smoothly rounded top surfaces corresponding to the chamfered bottom surfaces.

It will be appreciated that fitting 10 can be formed in various sizes for use with heating elements of various diameters. It will also be appreciated that lip portion 22, while shown as a ring-shaped element surrounding aperture 21, could be provided in other forms, such as in a discontinuous ring composed of arcuate section, or in a square or hex-shaped configuration centered about aperture 21. Furthermore, while the fitting has been shown as having two opposed rotation-locking portions, it would be possible to provide a lesser or greater number of locking portions to suit other requirements. By reason of its ease of installation and avoidance of time-consuming soldering operations, the fitting of the invention is particularly well adapted for high-volume production operations wherein an economical mechanically-rigid liquid seal for a rod-type heating element or other sheathed electrical conductor capable of withstanding repeated loosening and tightening operations is required.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

For example, the fitting may be attached by the described method to an unfilled portion of the sheath or to an empty sheath. Also, although a circular cross-sectional sheath is preferred, the invention, in at least its broader aspects, could also be employed with non-circular shaped sheaths.

I claim:

1. A method of securing a fitting to a sheathed electrical conductor, the fitting being of the type which sealably passes the conductor through an aperture in a bulkhead, and includes a flange portion having a diameter greater than the bulkhead aperture, a sleeve portion integrally adjacent and concentric with said flange portion having an outer diameter smaller than the bulkhead aperture and a length greater than the thickness of the bulkhead, and a threaded portion for receiving a fastener for drawing said flange portion into engagement with the bulkhead, said flange and sleeve portions including an axially-extending aperture dimensioned to slidably receive in surface contact the sheath of the conductor, and a lip on the face of said flange portion adjacent to said axially-extending aperture, said method including the steps of:

inserting the sheathed electrical conductor through the axially-extending aperture so as to bring the sheath into surface-contact with the wall of the axially-extending aperture; and axially compressing the lip into the face of the flange portion so as to force the wall of the axially-extending aperture and the sheath to be radially deformed whereby a mechanically-rigid liquid-sealing engagement is established between the fitting and the sheath.

2. A method for securing a fitting to a sheathed electrical conductor as defined in claim 1 wherein only a portion of the lip portion is axially compressed such that the radial deformation of the aperture wall and the sheath are out-of-round to establish a locked-rotation relation between the fitting and the conductor.

* * * * *